United States Patent [19]

Paice et al.

[11] Patent Number: 4,830,708

[45] Date of Patent: May 16, 1989

[54] **DIRECT BIOLOGICAL BLEACHING OF HARDWOOD KRAFT PULP WITH THE FUNGUS *CORIOLUS VERSICOLOR***

[75] Inventors: Michael G. Paice; Frederick S. Archibald; Lubomir Jurasek, all of Pointe Claire; Robert E. Bourbonnais, Ville St-Laurent; Ka-Kee Ho, Pierrefonds, all of Canada

[73] Assignee: Pulp and Paper Research Institute of Canada, Pointe Claire, Canada

[21] Appl. No.: 126,994

[22] Filed: Nov. 30, 1987

[51] Int. Cl.[4] ..... D21C 9/10; C12R 1/645

[52] U.S. Cl. ..... 162/72; 162/1; 435/171; 435/277; 435/278; 435/911

[58] Field of Search ..... 435/277, 278, 911, 171; 162/72, 9, 10, 1; 210/928

[56] References Cited

U.S. PATENT DOCUMENTS

| | | | |
|---|---|---|---|
| 3,406,089 | 10/1968 | Yerkes, Jr. | 162/72 |
| 3,962,033 | 6/1976 | Eriksson et al. | 435/277 |
| 4,162,939 | 7/1979 | Yoshikumi et al. | 435/911 |
| 4,655,926 | 4/1987 | Chang et al. | 210/611 |
| 4,690,895 | 9/1987 | Farrel | 162/72 |

OTHER PUBLICATIONS

Casey, "Pulp & Paper, 2nd Ed.", vol. I; Interscience Publishers, Inc., N.Y., 1960, pp. 456–457.

Martin et al., "Decolorization of Black Liquor with Polyporus Versicolor, a White Rot Fungus", *TAPPI,* vol. 52, No. 10; pp. 1975–1981, Oct. 1969.

*Primary Examiner*—Steve Alvo

*Attorney, Agent, or Firm*—Lawrence I. Field

[57] ABSTRACT

There is provided a process for bleaching kraft hardwood pulp wherein the bleaching is done utilizing the fungus *Coriolus versicolor* wherein the pulp is treated with the fungus at a temperature and for a time sufficient for the bleaching to occur. The pulp may subsequently be sterilized after bleaching.

17 Claims, No Drawings

DIRECT BIOLOGICAL BLEACHING OF HARDWOOD KRAFT PULP WITH THE FUNGUS *CORIOLUS VERSICOLOR*

FIELD OF THE INVENTION

The present invention relates to bleaching and more particularly, it relates to bleaching of kraft hardwood pulp utilizing a fungus.

BACKGROUND OF THE INVENTION

The bleaching of pulps is well known in the art and many different processes are commercially utilized. Generally, the processes utilize a chemical treatment of the pulp and in particular, chlorine is frequently utilized for its bleaching efficiency. However, these chemical treatments create the problem of effluent disposal Canadian Patent No. 758,488 to Jenness and Cooper describes a method of treating paper pulp with enzymes to improve the quality of the paper, although no mention is made of bleaching. USSR Pat. No. 321,563 to Grinberg et al and U.S. Pat. No. 3,962,033 to Eriksson et al describe methods respectively using enzymes and microorganisms to lower energy requirements during pulp refining. German Patent No. 3,110,117 to Eisenstein et al describes a somewhat similar process to that of Eriksson et al for pulping lignocellulosic material with white rot fungi, e.g. *Pleurotus ostreatus.* USSR Pat. No. 507,677 describes pretreatment of cellulosic raw material with a culture filtrate from wood decaying fungi to reduce sulphite pulping time and improve paper making properties. Swedish Patent No. 412,422 to Hartler describes a method of biological treatment of separated fibers from a first stage refining process which results in lower energy requirements in subsequent stages. Japanese Patent No. 10,240/82 to Oji Paper Company discloses mixing equal weights of pulp and mycelia of, for example, the mold *Rhizopus javanicus* to obtain paper. Canadian Patent No. 1,203,188 to Naylor et al discloses using a quinoid additive produced by a microorganism as a catalyst in the alkaline pulping of lignocellulose. French Patent No. 2,557,894 to Comtat et al discloses improving chemical pulp fibrillation by application of the enzyme xylanase.

Insofar as the mechanism is now understood, it is believed that when microorganisms and enzymes are used bleaching takes place due to lignin depolymerization. This may be catalyzed by the action of redox enzymes which may be produced in the action of a microorganism in the depolymerization of lignin.

Lignin degradation through the use of microorganisms has been studied, especially using white rot fungi such as *Phanerochaet chrysosporium.* The mechanism with *Phanerochaete chrysosporium* is now believed to include the rapid colonization of lignocellulosic fibers by hyphae through the lumens, followed by simultaneous degradation and removal of major wood components by extracellular biological reagents. A hydrogen peroxide dependent lignin peroxidase has been implicated as one enzyme involved in lignin degradation especially in the degradation of model compounds lignin. Other redox enzymes are probably also required for total mineralization. Active oxygen species (i.e. $^1O_2$, $OH\cdot$, $O_2^-$)and some one-electron carriers, e.g. veratryl alcohol, may allow lignin degradation in the middle lamella, which presumably is inaccessible to enzymes originating in the lumen.

Kraft pulp can be partially delignified by *Phanerochaete chrysosporium* provided that the fungal treatment is followed by alkaline extraction or provided that the treatment is prolonged, e.g. ten days in unagitated cultures. Farrell, in U.S. Pat. No. 4,690,895, claims that ligninolytic enzymes present in extracellular growth medium from a fermentation of *Phanerochaete chrysosporium* can be used to bleach kraft pulp. However, hydrogen peroxide must be added, and the enzyme treatment is followed by alkaline extraction. It has also been found by others in the scientific literature that the enzyme xylanase aids delignification, presumably by liberating lignin from a complex with hemicellulose.

The physiology and enzymology of other white rot fungi may or may not be similar. It has now been found that other white rot fungi such as *Coriolus* and *Pleurotus* species are capable of lignin depolymerization. In particular, we have used *Coriolus versicolor,* a species isolated and assessed by us for the treatment of effluent from pulp and paper operations. A specimen of *Coriolus versicolor* has been deposited with the American Type Culture Collection as ATCC No. 20869.

It is an object of the invention to provide an improved process for bleaching in kraft pulp treatment.

It is another object of the invention to provide a process of bleaching kraft hardwood pulp using *Coriolus versicolor.*

It is another object of the invention to provide paper from kraft hardwood pulp that has been bleached through the action of *Coriolus versicolor.*

BRIEF DESCRIPTION OF THE INVENTION

According to one aspect of the invention, there is provided a process for bleaching kraft hardwood pulp. The process comprises the step of treating the pulp with up to 25%, based on the weight of oven dried pulp, of mycelium of the fungus *Coriolus versicolor* (ATCC 20869). The pulp is preferably at a consistency below 50% and the mixer is maintained at a temperature of 15° to 50° C. The treatment lasts for a period of time sufficient for bleaching to occur.

As will be appreciated by those skilled in the art, the process conditions can be varied depending upon the desired results and cost efficiencies involved. Thus, for example, while the reaction conditions can include a consistency of up to 50% , the preferred pulp consistency would range between 1% and 10%. Similarly, a preferred percentage of the fungus, by weight of O.D. (oven-dried) pulp, is between 0.1% to 10% and more preferably, between 0.1% and 5% of the mycelium of *Coriolus versicolor.*

The bleaching reaction is preferably carried out at a temperature which results in the most active bleaching reaction. The temperature must be high enough to permit the fungus to react with the pulp material while not sufficiently high to kill the fungus. A suitable range is between 15° C. and 50° C. and more preferably, between 20° C. and 40° C.

The reaction time, as will be discussed in greater detail herein below, can vary depending upon other process parameters. In general, it has been found that a time between 24 hours to 120 hours is suitable.

Subsequent to the bleaching, the pulp may be washed and subjected to one or more subsequent steps. One such step is to terminate fungal action by sterilizing the mycelium. Preferably, sterilization is effected by heating the pulp mixture at a temperature of 120° C. or above.

Embodiments of the invention are illustrated by the following examples in conjunction with the tables of results referred to therein.

EXAMPLE I

A selected group of microorganisms was screened for their ability to bleach kraft pulp. The strains were:

| | |
|---|---|
| #52 | *Coriolus versicolor* (ATCC 20869) |
| #170 | *Phellinus pini* |
| #358 | *Pleurotus eryngii* |
| #383 | *Phanerochaete chrysosporium* (ATCC 24725) |
| #405 | *Pleurotus sajor-caju* |
| #406 | *Lentinus edodes* |
| #434 | *Aureobasidium pullulans* |

The #numbers refer to the PAPRICAN (Pulp and Paper Research Institute of Canada) culture collection. Strain #170 originates from the collection of J. E. Purkynie University, Brno. Strain #358 originates from F. Zadrazil, Institut fuer Bodenbiologie, Braunschweig.

Strains were maintained on malt agar slans. Malt agar petri dishes were inoculated and grown for 4 to 5 days. Three discs, each about one cm in diameter, were taken from the growing edge and were used to prepare liquid inocula in a 500 mL shake flask containing 200 mL mycological broth at 30° C. and 200 rpm. A glass marble was added to each flask to prevent pellet formation. Unbleached kraft pulp was obtained from two eastern Canadian mills (hardwood; approximate kappa number 12) or from the PAPRICAN pilot plant (spruce; approximate kappa number 30). For pulp treatments with fungi, 30 g of pulp was sterilized in one litre of deionized water in 4-liter polypropylene screw-capped bottles containing bubbling tubes for sterile addition of air. Liquid inoculum was added to the flasks to give 3-gram additions of total solids (approximately 80 mL of culture). The total volume of the pulp suspension was made up to 2 liters with deionized water. The bottles were shaken at 100 rpm at 30° C. with an airflow of about 2 liters/min (humidified air) for up to 5 days. The pulp was then homogenized with a Brookfield counter rotating mixer and filtered with fines recycled through a polyethylene macrofilter (Spectrum) of 290 μm mesh opening. The bleached pulp was also extracted with 2% sodium hydroxide to remove lignin.

Handsheets were made of both the extracted and unextracted pulps, and tested according to the standard methods of the Technical Section of the Canadian Pulp and Paper Association. The ISO brightness was determined at 681 nm with an Elrepho instrument. Chemical bleaching and enzyme assays were also performed.

Results are set out in Table 1.

TABLE 1

The effect of fungi on brightness, lignin, and cellulose in unbleached hardwood kraft pulp

| | Control | #52 | #170 | #358 | #383 | #405 | #406 | #434 |
|---|---|---|---|---|---|---|---|---|
| Brightness % ISO | 33.5 | 48.1 | 35.9 | 34.4 | 35.7 | 35.8 | 35.9 | 36.0 |
| Kappa number | 11.6 | 7.9 | 12 | 12 | 10.9 | 10.2 | 11.7 | 12.4 |
| Viscosity | 17 | 11.2 | 15.9 | 16 | 13.5 | 10.9 | 17.8 | 15.1 |
| Klason lignin | 1.0 | 0.66 | 1.39 | 1.56 | 1.1 | 1.41 | 1.33 | 2.04 |
| UV lignin | 0.6 | 0.63 | 0.69 | 0.67 | 0.58 | 0.61 | 0.63 | 0.49 |
| After extraction: | | | | | | | | |
| Brightness | 34.3 | 49.5 | 35.9 | 34.8 | 35.6 | 37.0 | 35.3 | 34.8 |
| Kappa number | 10.9 | 6.5 | 11.2 | 12.1 | 10.4 | 9.4 | 11.4 | 11.4 |
| Viscosity | 15.3 | 10.4 | 14.6 | 14.4 | 13.4 | 10.9 | 16.8 | 14.4 |
| Klason lignin | 0.98 | 0.49 | 1.01 | 1.2 | 0.98 | 1.06 | 1.09 | 1.58 |
| UV lignin | 0.7 | 0.51 | 0.7 | 0.67 | 0.65 | 0.58 | 0.69 | 0.86 |

Relative to an uninoculated control only the *Coriolus versicolor* treated pulp showed a marked increase in brightness. The other fungi produced little change. The increased brightness with *Coriolus versicolor* was accompanied by a decrease in both kappa and Klason lignin, indicating lignin removal from the pulp. However, the viscosity of the pulp decreased appreciably indicating that some cellulose degradation occurred.

Extraction of the pulps with 2% alkali following the fungal treatment gave no increased brightness or kappa loss for the *Coriolus*-treated pulp. The pulp treated with *Pleurotus sajor-caju* did show slightly increased brightness on alkaline extraction.

Thus it is found that *Coriolus versicolor* can bleach kraft pulp by up to 15 brightness points.

EXAMPLE II

Unbleached kraft pulps from two other eastern Canadian mills were incubated with *Coriolus versicolor* as described in Example I. The pulps which originated from mixed hardwood were brightened considerably, while the other pulp which was a softwood pulp showed no brightening increase or lignin loss.

Results are shown in Table 2.

TABLE 2

Treatment of unbleached kraft pulps from three mills with *Coriolus versicolor.*

| | Hardwood 1 | | Hardwood 2 | | Softwood | |
|---|---|---|---|---|---|---|
| | Control | Treated | Control | Treated | Control | Treated |
| Brightness | 33.5 | 48.0 | 33.2 | 47.7 | 28.8 | 24.2 |
| Kappa No. | 11.6 | 7.9 | n.d. | n.d. | n.d. | n.d. |
| Klason lignin | 1.7 | 0.66 | n.d. | n.d. | n.d. | n.d. |

n.d. = not determined

EXAMPLE III

Unbleached hardwood pulp was allowed to react with mycelium of *Coriolus versicolor* as described in Example I. The brightness was noted on a daily basis.

The results are shown in Table 3.

Most of the brightening effect took place on the second day and was preceded by a one day lag period. The decrease in kappa number and viscosity parallel each other and changed most rapidly on the second day.

In spite of the viscosity loss, the handsheet properties of 5-day treated pulp from this experiment indicated strength improvements as may be seen from Table 4. At the same basis weight, the tear, breaking length, burst and stretch were all increased.

TABLE 3

Effect of incubation time on brightness, kappa number and viscosity.

| Incubation time days | ISO Brightness % | Kappa Number | Viscosity mPa.s |
|---|---|---|---|
| 0 | 32.8 | 11.9 | 17.5 |
| 0.5 | 32.7 | 11.7 | 17.8 |
| 1 | 31.7 | 12.2 | 18.8 |
| 2 | 43.5 | 9.2 | 15.1 |
| 3 | 47.7 | 8.4 | 14.8 |
| 4 | 49.5 | 7.2 | 14.2 |
| 5 | 50.1 | 7.0 | 13.9 |

TABLE 4

Physical properties of handsheets from 5-day *Coriolus versicolor* treated kraft pulp.

| | Control Hardwood Pulp | Treated Hardwood Pulp |
|---|---|---|
| Freeness, ML | 548 | 520 |
| Basis wt, g/m$^2$ | 60.1 | 60.1 |
| Caliper, m | 119 | 113 |
| Burst index, kPa.m$^2$/g | 1.05 | 1.53 |
| Tear index, mN.m$^2$/g | 5.21 | 6.55 |
| Breaking length, km | 2.66 | 3.27 |
| Stretch, % | 1.33 | 1.74 |

EXAMPLE IV

To determine the effect of reducing sugars, different concentrations of glucose were added to a mixture of *Corioulus versicolor* mycelium as describe in Example I. Following a 5-day incubation, a significant increase in brightness was found at higher glucose concentrations, as can be seen from Table 5. These results were obtained in Fernback glass flask which allowed more agitation of the suspensions than the plastic 4-liter bottles.

TABLE 5

Effect of glucose concentration on brightness of pulp following 5-day treatment with *Coriolus versicolr*. Initial pulp brightness was 33.5% ISO

| | Sample 1 | Sample 2 | Sample 3 | Sample 4 | Sample 5 |
|---|---|---|---|---|---|
| Glucose conc., mM | 0 | 10 | 25 | 40 | 50 |
| Brightness, % ISO | 53.2 | 55.5 | 56.3 | 56.0 | 59.3 |

EXAMPLE V

A pulp bleached wholly by conventional chlorine bleaching (CEDED) was compared with a pulp for which the initial chlorination and extraction were replaced by the fungal (=mycelial) treatment (M) with *Coriolus versicolor* (MDED) as described in Example I. The results are shown in Table 6. The fungal treatment left more lignin in the pulp which probably accounts for the six-point difference in brightness.

TABLE 6

Combined fungal and chemical treatment of pulp

| | Control pulp CEDED | Coriolus pulp MDED |
|---|---|---|
| Brightness (5 day) | 32.7 | 50.1 |
| Extraction brightness | 46.9 | — |
| First ($D_1$) stage: | | |
| brightness | 81.7 | 62.7 |
| kappa number | 0.9 | 4.3 |
| viscosity | 11.8 | 13.2 |
| Second ($D_2$) stage: | | |
| brightness | 88.1 | 82.3 |

TABLE 6-continued

Combined fungal and chemical treatment of pulp

| | Control pulp CEDED | Coriolus pulp MDED |
|---|---|---|
| viscosity | 11.2 | 12.6 |

EXAMPLE VI

Unbleached hardwood pulp of example one was allowed to react with mycelium of *Coriolus versicolor* for four days. The mixture of pulp and mycelium was then washed, and the inoculation and 4-day incubation was repeated with fresh inoculum. Under these conditions, the ISO brightness after the first incubation (average 54.4) was increased after the second incubation to an average of 59.9.

In the foregoing examples, seven fungal strains were tested for their direct ability to bleach hardwood kraft pulp under aerobic, agitated conditions. It was concluded that the white rot fungus *Coriolus versicolor* produced the brightest pulp in 4 to 5-day treatments. The brightness increased by 15 points to 48% ISO, with a corresponding decrease in kappa number from 11.6 to 7.9. The handsheet strength properties (burst, tear, breaking length and stretch) were all improved in the treated pulp in spite of the viscosity drop indicating cellulose chain cleavage. Most of the brightening effect occurred during the second day of the reaction, following an initial lag period. The addition of supplemental glucose (50 mM) to the reaction increased the final brightness, in one case to 59% ISO. Combined fungal (without glucose) and chemical bleaching gave a pulp of 82% ISO brightness, whereas conventional chlorine chemical bleaching gave 88%. Initial experiments to determine the yield of the fungal treatments indicate that it is essentially quantitative.

It is understood that the above described embodiments are for purposes of illustration only and changes and modifications may be made thereto without departing from the spirit and scope of the invention.

We claim:

1. A process for bleaching- kraft hardwood pulp comprising the step of treating the pulp with up to 25%, based on the weight of oven dried pulp, of mycelium of the fungus *Coriolus versicolor* (ATCC 20869) at a temperature between 15° C. and 50° C. and at a pulp consistency of below 50% for a period of time to permit bleaching to occur.

2. A process as claimed in claim 1, in which the pulp mixture is agitated during bleaching.

3. A process as claimed in claim 2, wherein the consistency is between 1% and 10%.

4. A process as claimed in claim 1, in which the pulp is treated with from 0.1 to 10% of mycelium of *Coriolus versicolor* based on oven-dry weight of pulp.

5. A process as claimed in claim 3, in which the pulp is treated with from 0.1 to 5% of mycelium of *Coriolus versicolor* based on oven-dry weight of pulp.

6. A process as claimed in claim 3, in which the temperature range is from 20° C. to 40° C.

7. A process as claimed in claim 1 carried out for a time of from 24 hours to 120 hours.

8. A process as claimed in claim 1, in which at least one nutrient is added to the mix.

9. A process as claimed in claim 8, in which the nutrient is glucose.

10. A process as claimed in claim 1, which includes a subsequent step of washing the pulp with water.

11. A process as claimed in claim 1, which includes a subsequent step of applying chemical bleaching to the pulp.

12. A process as claimed in claim 1, which includes a subsequent step of sterilizing the mycelium.

13. A process as claimed in claim 12, wherein the step of sterilization consists of heating the pulp mixture at a temperature of 120° C. or above.

14. A process for bleaching hardwood kraft pulp having a consistency of from 1 to 10%, comprising mixing the pulp with from 0.1 to 10% of mycelium of the fungus *Coriolus versicolor* (ATCC 20869) based on oven-dry weight of pulp and maintaining the mixture at a temperature of between 20° and 40° C. for a period of from 24 to 120 hours.

15. A process as claimed in claim 14, which includes a step of adding glucose to the mix.

16. A process as claimed in claim 14, in which the glucose is added at a concentration of about 50 mM.

17. A process as claimed in claim 14 where the fungal addition is repeated one or more times over the period of time required to permit bleaching to occur.

* * * * *